US005564246A

United States Patent [19]

Champagne

[11] Patent Number: 5,564,246

[45] Date of Patent: Oct. 15, 1996

[54] PUSH TAB FOR SIDING

[75] Inventor: Wendel J. Champagne, Tomball, Tex.

[73] Assignee: Tommy W. Hollis, Conroe, Tex.

[21] Appl. No.: 285,321

[22] Filed: Aug. 3, 1994

[51] Int. Cl.[6] ..... E04D 1/34; E04B 2/00; E04F 13/00

[52] U.S. Cl. ..... 52/548; 52/520; 52/526.05; 52/715; 52/489.2; 52/478

[58] Field of Search ..... 52/715, 712, 520, 52/543–548, 550–552, 506.05, 478, 489.1, 489.2

[56] References Cited

U.S. PATENT DOCUMENTS

| | | | |
|---|---|---|---|
| 1,520,947 | 12/1924 | Harris | 52/548 X |
| 1,941,216 | 12/1933 | McKeown | 52/545 |
| 2,060,739 | 10/1936 | Maddux | 52/548 |
| 2,227,939 | 1/1941 | Kridler | 52/548 |
| 2,591,361 | 4/1952 | Knott | 52/489.1 |
| 2,916,113 | 12/1959 | Lee | 52/633 |
| 3,020,988 | 2/1962 | Bransford | 52/512 |
| 3,154,889 | 11/1964 | Monroe | 52/249 |
| 3,300,934 | 1/1967 | Waizenhofer | 52/394 |
| 3,438,168 | 4/1969 | Tischuk | 52/478 |
| 3,512,222 | 5/1970 | Tinnerman | 24/561 |
| 4,854,101 | 8/1989 | Champagne . | |
| 4,947,609 | 8/1990 | Champagne | 52/545 |
| 5,325,641 | 7/1994 | Felton | 52/36.4 |
| 5,339,608 | 8/1994 | Hollis et al. | 52/545 |
| 5,392,579 | 2/1995 | Champagne | 52/520 |

FOREIGN PATENT DOCUMENTS

| | | | |
|---|---|---|---|
| 0620263 | 3/1949 | United Kingdom | 52/489.1 |

*Primary Examiner*—Robert J. Canfield
*Attorney, Agent, or Firm*—John R. Casperson

[57] ABSTRACT

There is disclosed a mounting clip for siding. The clip has a first face and a second face. The clip is formed from a continuous metal strip. The continuous metal strip has a portion of a generally J-shaped configuration. The generally J-shaped portion has a first upright leg and a second upright leg connected by a generally U-shaped bight. The second end of the first upright leg is connected to the first end of the generally U-shaped bight. The second end of the U-shaped bight is connected to the first end of the second upright leg. The continuous metal strip has at least one outwardly facing barb protruding from the second face of the second upright leg. The at least one outwardly facing barb points away from the U-shaped bight. When the clip is positioned over the top butt of a lower panel, the bottom butt of an upper panel can be engaged by the at least one barb to position the upper panel above the lower panel.

8 Claims, 3 Drawing Sheets

PUSH TAB FOR SIDING

BACKGROUND OF THE INVENTION

This invention relates to a mounting clip for joining siding panels. In one aspect, this invention relates to a mounting clip for mounting vinyl siding panels to each other. In another aspect, this invention relates to a clip for mounting the top siding row of panels to the next to top siding row of panels. In yet another aspect, this invention relates to a method for joining siding panels.

There are numerous reasons the building industry has had a preference for the use of vinyl siding. These reasons include, but are not restricted to, the fact that such siding has low wear and maintenance characteristics. Vinyl panels are generally extruded or formed into individual panels 12 feet long and 8 or 10 inches wide. Each panel is profiled to simulate one or more rows of the traditional lapped wooden siding and can even have a textured finish to complete the illusion of wooden siding. The panels are made with permanent coloring and with a variety of surface finishes all leading to the above mentioned low maintenance characteristics.

The rows of vinyl siding are installed with the panels in overlapping and/or interlocking rows starting from the bottom of the wall. Each panel has an inturned bottom butt which is received in a downwardly directed channel configuration of the upper butt of the adjacent panel. The panel used at the top of a section of wall can be either a specially formed panel or, more likely, a standard panel modified to remove at least the upper butt and what ever panel surface necessary to make a proper fit. The lower edge of this panel engages the butt of the upper most row of siding and its upper edge is received under the bottom lip of a finish trim. This is where there has been a problem in the past in that these top panels do not have the upper nail strip of the standard panel covering the remainder of the wall. No vinyl panel, regardless of its configuration, can have nails driven through the face. This would clearly mar the finished appearance while preventing the relative movement of the panels which is necessary to accommodate for differences in expansion and contraction due to changes in ambient temperature conditions.

A clip to hold a panel above another panel, especially a clip to hold a topout panel above a next to top row panel, would be very desirable.

OBJECTS OF THE INVENTION

It is an object of this invention to provide a clip for joining siding panels.

It is another object of this invention to provide such a clip that does not require special tools to install.

It is another object of this invention to provide a clip that is especially well adapted to join an upper panel to a lower panel.

It is another object of this invention to provide a clip that is especially well adapted to join a topout panel to a next to top row panel.

It is another object of this invention is to provide a method for mounting a top out panel on a wall being covered by siding.

SUMMARY OF THE INVENTION

In one embodiment of the invention, there is provided a mounting clip for siding. The clip has a first face and a second face. The clip is formed from a continuous metal strip. The continuous metal strip has a portion of a generally J-shaped configuration. The generally J-shaped portion has a first upright leg and a second upright leg connected by a generally U-shaped bight. The second end of the first upright leg is connected to the first end of the generally U-shaped bight. The second end of the U-shaped bight is connected to the first end of the second upright leg. The continuous metal strip has at least one outwardly facing barb protruding from the second face of the second upright leg. The at least one outwardly facing barb points away from the U-shaped bight. When the clip is positioned over the top butt of a lower panel, the bottom butt of an upper panel can be engaged by the at least one barb to position the upper panel above the lower panel.

When the mounting clip is further provided with at least one inwardly extending barb extending from the first face of the second upright leg pointing toward the first U-shaped bight, it becomes self fastening to the lower panel. The holding power of the clip to the lower panel can be further enhanced by providing the strip with a second U-shaped bight connected to the first U-shaped bight by a first end and coming to a point to engage the lower panel at the second end.

In another aspect, there is provided a method for mounting a top row of siding panels to a next-to-top row. A next-to-top row of siding panels is secured to a wall portion to be covered by siding panels. A plurality of clips are mounted spaced along a top edge of said next-to-last row panel. Each such clip can be as described above. The first face of the generally U-shaped bight of each clip contacts a top butt portion of the next-to-top row panel. A top out panel is mounted by inserting its upper edge under a soffit panel and engaging a bottom butt of the top out panel with the at least one outwardly facing barb of each clip. Where each mounting clip further comprises at least one inwardly extending barb extending from the first face of the second leg, pointing toward the first U-shaped bight, the clips may be mounted by pressing the generally U-shaped bight of each clip over the top butt portion of the next-to-top row panel to engage the at least one inwardly extending barb with the top butt portion of the next-to-top row panel. The holding power of the clips to the top row panel can be enhanced by providing each clip with a point at the second end of the second U-shaped bight which bends away from the first face of the generally straight leg of the second U-shaped bight at an angle in the range of from about 30 degrees to about 60 degrees so as to engage a portion of the next to top row panel.

DETAILED DESCRIPTION OF THE PREFERRED EMBODIMENTS

Figure 1:
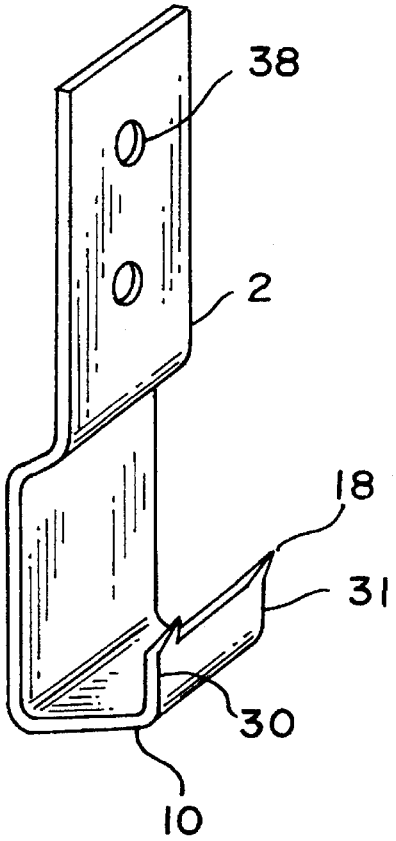
FIG. 1 is a pictorial representation of a clip embodying certain aspects of the present invention according to a first embodiment.

In one embodiment of the invention, there is provided a mounting clip 2 for siding. The clip 2 has a first face 4 and a second face 8. The clip is formed from a continuous metal strip. The continuous metal strip has a portion 10 of a generally J-shaped configuration. The generally J-shaped portion has a first upright leg 12 and a second upright leg 14 connected by a generally U-shaped bight 16. The second end of the first upright leg 12 is connected to the first end of the generally U-shaped bight 16. The second end of the U-shaped bight 16 is connected to the first end of the second upright leg 14. The continuous metal strip has at least one outwardly facing barb 18 protruding from the second face of the second upright leg 14. The at least one outwardly facing barb 18 points away from the U-shaped bight 16. When the clip 2 is positioned over a top butt 20 of a lower panel 22, a bottom butt 24 of an upper panel 26 can be engaged by the at least one barb 18 to position the upper panel 26 above the lower panel 24.

In a preferred embodiment of the invention, the at least one outwardly facing barb 18 comprises a first triangular barb positioned adjacent to a first side edge 30 of the second upright leg 14 and a second triangular barb positioned adjacent to a second side edge 31 of the second upright leg 14. In the illustrated embodiment of the invention the first upright leg 12 comprises a first generally straight section 32 having a first end and a second end and a second generally straight section 34 having a first end and a second end and a bent section 36 connecting the second end of the first generally straight section 32 with the first end of the second generally straight section 34. Each section has a first face and an oppositely facing second face corresponding the first face and the second face of the continuous metal strip. The second end of the second generally straight section 34 is connected to the first end of the U-shaped bight 16.

Generally, the first face of the first upright leg 12 faces the first face of the second upright leg 14. In the embodiment illustrated in FIG. 2, the first l:ace of the bent section 36 faces the first face of the second upright leg 14. The first generally straight section 32 and the second generally straight section 34 are positioned in generally parallel planes. Where a nailable clip is desired, the clip 2 can be provided with at least one borehole 38 extending from the first face to the second face is defined in the first generally straight section 32.

Figure 3:
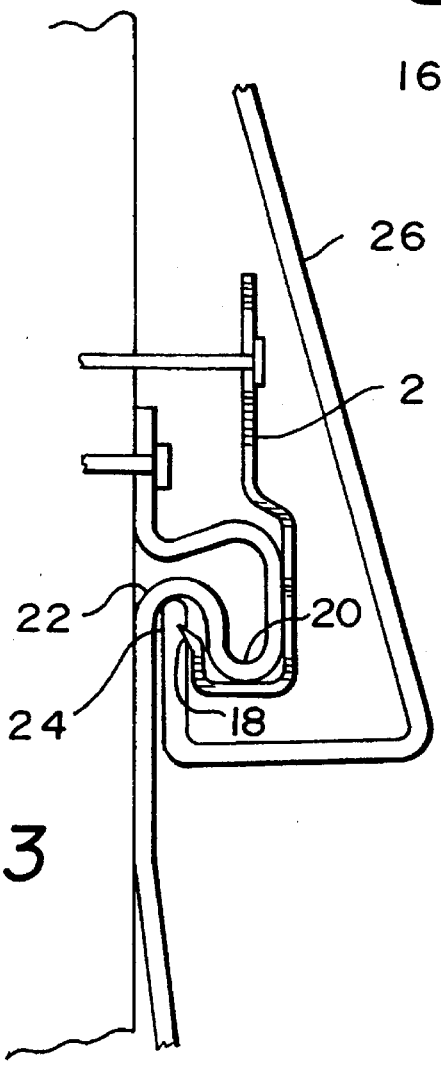
FIG. 3 is a side sectional view of a clip as shown in FIG. 1 being used to position a panel above another panel.
Figure 4:
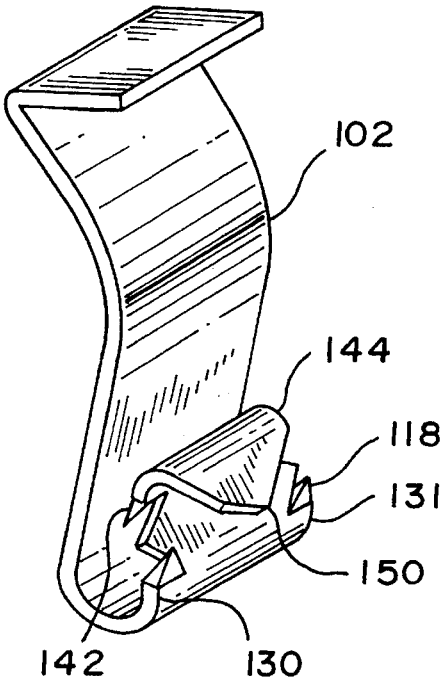
FIG. 4 is a pictorial representation of a clip embodying certain aspects of the invention according to a second embodiment.

In one embodiment of the invention, the second end of the second upright leg 14 forms an end of the strip and the first triangular barb and the second triangular barb are positioned at the second end of the second upright leg 14. Usually, each outwardly facing barb forms an angle in the range of between about 30 degrees and about 60 degrees with respect to the second face of the second upright leg 14 to better engage the upper panel, as best shown by FIG. 3.

In another embodiment of the invention, there is provided a mounting clip 102 for siding. The clip 102 has a first face 104 and a second face 108. The clip is formed from a continuous metal strip. The continuous metal strip has a portion 110 of a generally J-shaped configuration. The generally J-shaped portion has a first upright leg 112 and a second upright leg 114 connected by a generally U-shaped bight 116. The second end of the first upright leg 112 is connected to the first end of the generally U-shaped bight 116. The second end of the U-shaped bight 116 is connected to the first end of the second upright leg 114. The continuous metal strip has at least one outwardly facing barb 118 protruding from the second face of the second upright leg 114. The at least one outwardly facing barb 118 points away from the U-shaped bight 116. When the clip 102 is positioned over a top butt 120 of a lower panel 122, a bottom butt 124 of an upper panel 126 can be engaged by the at least one barb 118 to position the upper panel 126 above the lower panel 124.

In a preferred embodiment of the invention, the at least one outwardly facing barb 118 comprises a first triangular barb positioned adjacent to a first side edge 130 of the second upright leg 114 and a second triangular barb positioned adjacent to a second side edge 131 of the second upright leg 114. In the illustrated embodiment of the invention the first upright leg 112 comprises a first generally straight section 132 having a first end and a second end and a second generally straight section 134 having a first end and a second end and a bent section 136 connecting the second end of the first generally straight section 132 with the first end of the second generally straight section 134. Each section has a first face and an oppositely facing second face corresponding the first face and the second face of the continuous metal strip. The second end of the second generally straight section 134 is connected to the first end of the U-shaped bight 116.

Figure 5:
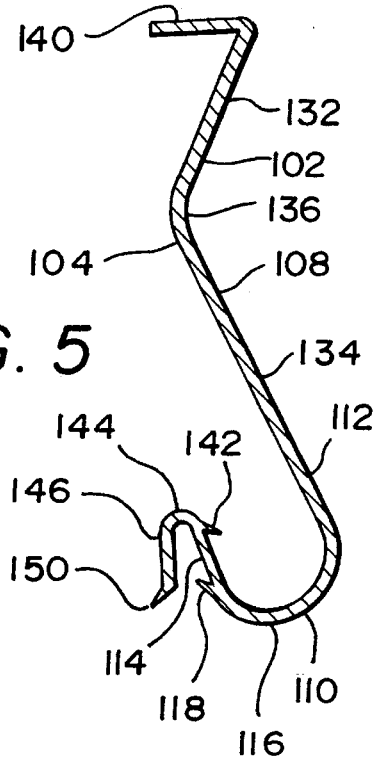
FIG. 5 is a side view of the clip of FIG. 4.
Figure 6:
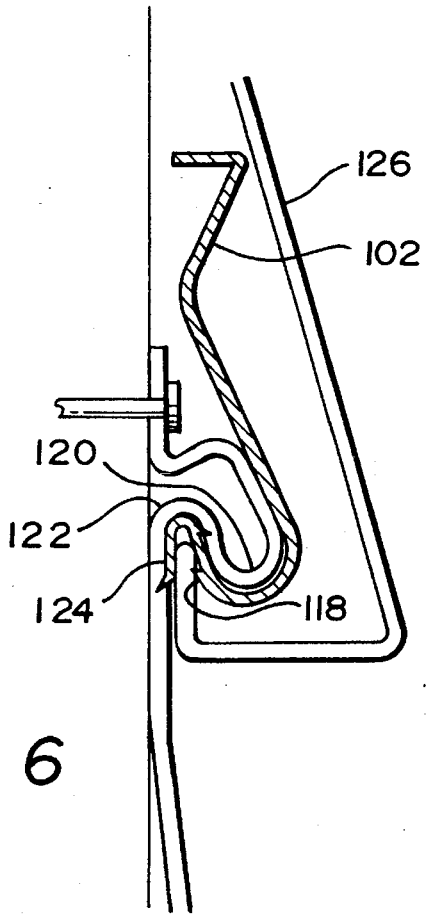
FIG. 6 is a side sectional view of a clip as shown in FIG. 4 being used to position a panel above another panel.
Figure 7:
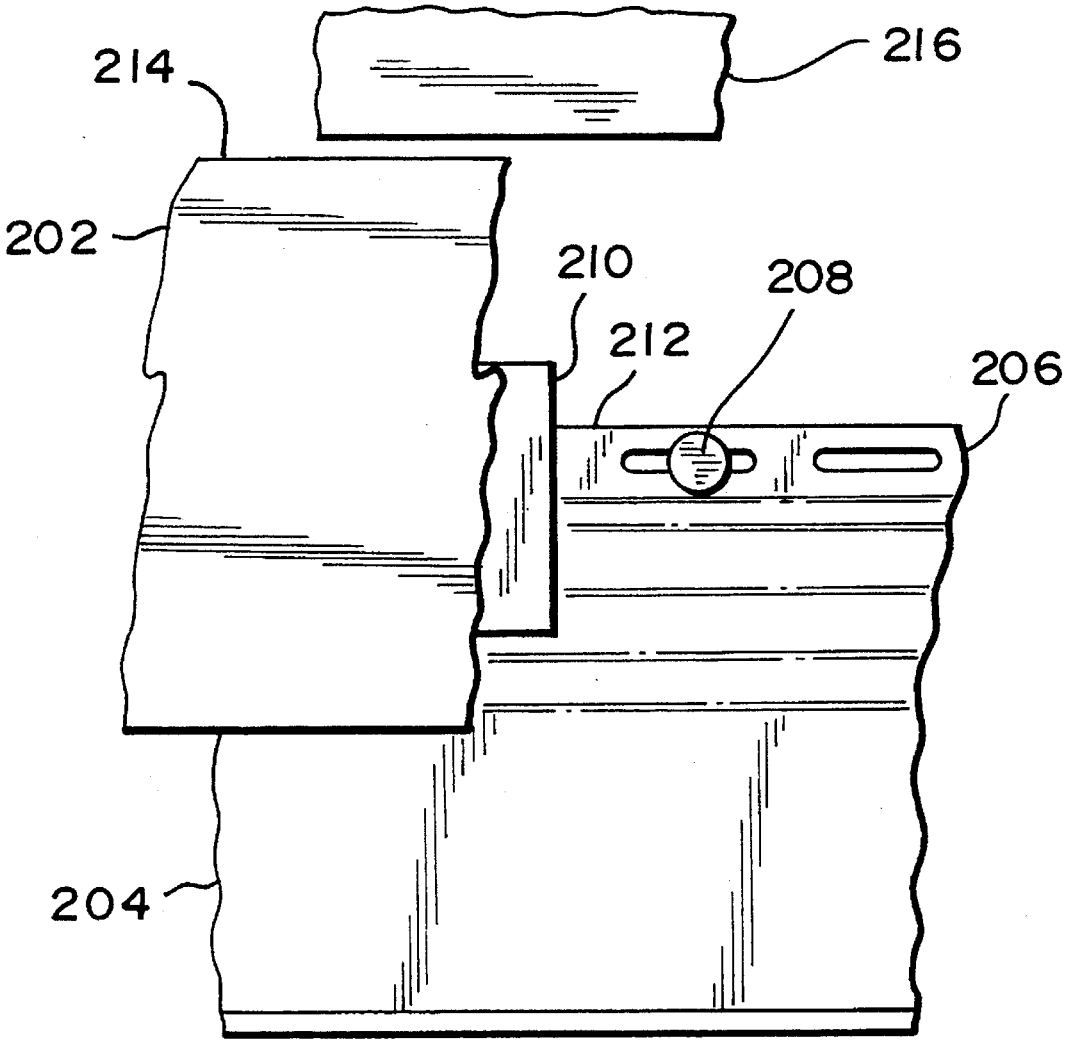
FIG. 7 is a schematic view showing how the clips shown in FIGS. 1 and 4 may be used to join panel sections.

Generally, the first face of the first upright leg 112 faces the first face of the second upright leg 114. In the embodiment illustrated in FIG. 5, the bent section 136 curves away from the U-shaped bight 116 so that the first generally straight section 132 forms an angle in the range of from about 120 degrees to about 160 degrees with the second generally straight section 134.

If desired, the clip 102 can be provided with a short horizontal leg 140 having a first end and a second end. The second end of the short horizontal leg 140 is connected to the first end of the first generally straight section 132 at an angle in the range of about 45 degrees to about 90 degrees. The short horizontal leg extends toward the second upright leg 114.

The mounting clip 102 is self fastening, and need not be provided with nail holes. To provide self fastening capabilities, at least one inwardly extending barb 142 extends from the first face of the second upright leg 114. The at least one inwardly extending barb 142 points toward the first U-shaped bight 116.

In a further preferred embodiment, the mounting clip 102 further comprises a second U-shaped bight 144 having a first face and a second face which correspond to the first face and the second face of the mounting clip, a first end, a second end and a generally straight portion 146 extending from the second end. The first end of the second U-shaped bight 116 is connected to the second end of the second upright leg 114. The second U-shaped bight 144 curves toward the second face of the clip.

In a preferred embodiment, the at least one inwardly extending barb 142 comprises a third triangular barb positioned adjacent to the first side edge 130 of the second upright leg 114 between the first barb and the second U-shaped bight 144 and a fourth triangular barb positioned adjacent to the second side edge of the second upright leg 114 between the second barb and the second U-shaped bight 144. The third triangular barb and the fourth triangular barb are preferably formed from a portion of the second upright leg 114 and are oriented at an angle in the range of from about 30 degrees to about 60 degrees with respect to the second upright leg.

In a preferred embodiment, the strip comes to a point 150 at the second end of the second U-shaped bight 144. The point 150 enables the clip to better engage the lower panel 122. Preferably, the point 150 bends away from the first face of the generally straight portion 146 of the second U-shaped bight 144 at an angle in the range of from about 30 degrees to about 60 degrees. Because the points and barbs must fit into the groove formed by the butt section of the lower panel 122, it is preferred that the outwardly extending barbs, the inwardly extending barbs, and the point be positioned closely together.

It is important that the clip have adequate spring strength to perform its function. For vinyl siding, a mounting which is formed from stainless steel spring stock will provide good results. The blank stock can have a length in the range of about 0.5 inches to about 4 inches, preferably about 1 inch to about 3 inches and a width in the range of about 0.25 inches to about 3 inches, preferably about 0.5 inches to about 1 inch, and a thickness in the range of from about 0.003 inches to about 0.020 inches, preferably about 0.009 inches to about 0.015 inches. An exemplary clip can be formed from 2.5×0.5×0.012 inch stock.

In another embodiment of the invention, there is provided a method for mounting a top row 202 of siding panels to a next-to-top row 204. The next-to-top row of siding panels 204 is secured to a wall portion to be covered by siding panels. This can be accomplished by nailing the row utilizing a nail hem 206 and at least one nail 208. A plurality of clips 210 are mounted spaced along a top edge 212 of said next-to-last row panel. Each such clip can be as described above. The first face of the generally U-shaped bight of each clip contacts a top butt portion the next-to-top row panel. A top out panel is mounted by inserting its upper edge 214 under a soffit panel 216 and engaging a bottom butt of the top out panel with the at least one outwardly facing barb of each clip. Where each mounting clip further comprises at least one inwardly extending barb extending from the first face of the second leg, pointing toward the first U-shaped bight, the clips may be mounted by pressing the generally U-shaped bight of each clip over the top butt portion of the next-to-top row panel to engage the at least one inwardly extending barb with the top butt portion of said next-to-top row panel. In other embodiments of the invention, the clips can be nailed to the wall portion being covered. Where the clips are provided with the second U-shaped bight, the upper panel can be mounted to the lower panel by inserting the bottom butt of the upper panel into the second U-shaped bight. The holding power of the clips can be enhanced by providing the clip with a point on the end of the second U-shaped bight and engaging the point of each mounting clip with a portion of the next-to-top row panel.

EXAMPLE

Figure 2:
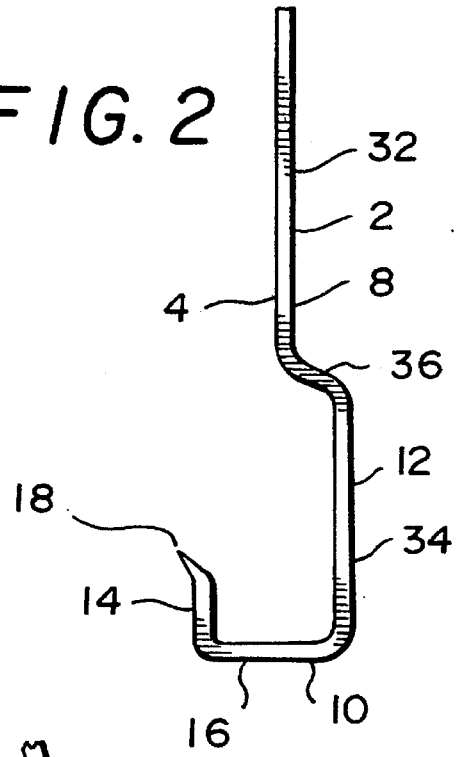
FIG. 2 is a side view of the clip of FIG. 1.

Prototypes of a mounting clip substantially as shown in FIGS. 1–3 were installed and tested on three houses in Texas in 1990. The installations were inspected for indications of premature failure (anticipated life of the siding is 40 years) in 1994. There were revealed no indications that the clips were functioning in other than a satisfactory manner.

I claim:

1. A mounting clip for siding comprising a continuous metal strip having a first face and a second face, said continuous metal strip having a portion of a generally J-shaped configuration with a first upright leg having a first end and a second end, a second upright leg having a first end and a second end, and a generally U-shaped bight having a first end and a second end connecting the first upright leg with the second upright leg, wherein the second end of the first upright leg is connected to the first end of the generally U-shaped bight, and the second end of the U-shaped bight is connected to the first end of the second upright leg, said continuous metal strip further defining at least one outwardly facing barb protruding from the second face of the second upright leg, said at least one outwardly facing barb pointing away from the U-shaped bight;

wherein the first face of the first upright leg faces the first face of the second upright leg;

wherein the at least one outwardly facing barb comprises a first triangular barb positioned adjacent to a first side edge of the second upright leg and a second triangular barb positioned adjacent to a second side edge of the second upright leg;

wherein the first upright leg comprises a first generally straight section having a first end and a second end and a second generally straight section having a first end and a second end and a bent section connecting the second end of the first generally straight section with the first end of the second generally straight section each section having a first face and an oppositely facing second face corresponding to the first face and the second face of the continuous metal strip, wherein the second end of the second generally straight section is connected to the first end of the U-shaped bight;

wherein the bent section curves away from the U-shaped bight so that the first generally straight section forms an angle in the range of from about 120 degrees to about 160 degrees with the second generally straight section;

said mounting clip for siding further comprising a short horizontal leg having a first end and a second end, with the second end of the short horizontal leg being connected to the first end of the first generally straight section at an angle in the range of about 45 degrees to about 90 degrees, said short horizontal leg extending toward the second upright leg.

2. A mounting clip for siding comprising a continuous metal strip having a first face and a second face, said continuous metal strip having a portion of a generally J-shaped configuration with a first upright leg having a first end and a second end, a second upright leg having a first end and a second end, and a first generally U-shaped bight having a first end and a second end connecting the first upright leg with the second upright leg, wherein the second end of the first upright leg is connected to the first end of the first generally U-shaped bight, and the second end of the first generally U-shaped bight is connected to the first end of the second upright leg, said continuous metal strip further defining first and second outwardly facing barbs protruding from the second face of the second upright leg, said outwardly facing barbs pointing away from the first generally U-shaped bight;

said mounting clip further comprising first and second inwardly extending barbs extending from the first face of the second upright leg, said inwardly extending barbs pointing toward the first generally U-shaped bight, and said mounting clip further having a second generally U-shaped bight having a first face and a second face which correspond to the first face and the second face of the continuous metal strip, a first end, a second end and a generally straight portion extending from the second end, the first end of the second generally U-shaped bight being connected to the second end of the second upright leg, said second generally U-shaped bight curving toward the second face of the continuous metal strip.

3. A mounting clip as in claim 2 wherein the inwardly extending barbs are positioned between the outwardly facing barbs and the second generally U-shaped bight.

4. A mounting clip as in claim 3 wherein each barb is triangularly shaped and is formed from a portion of the second upright leg and is oriented at an angle in the range of from about 30 degrees to about 60 degrees with respect to the second leg, wherein the first inwardly extending barb and the first outwardly extending barb are positioned adjacent to a first side edge of the continuous metal-strip and the second inwardly extending barb and the second outwardly extending barb are positioned adjacent to a second side edge of the continuous metal strip.

5. A mounting clip as in claim 4 wherein the strip comes to a point at the second end of the second U-shaped bight, wherein said point bends away from the first face of the generally straight portion of the second U-shaped bight at an angle in the range of from about 30 degrees to about 60 degrees.

6. A mounting clip as in claim 5 wherein the outwardly extending barbs, the inwardly extending barbs, and the point are positioned closely together.

7. A mounting clip as in claim 2 which is formed from stainless steel spring stock having a length in the range of about 0.5 inches to about 4 inches and a width in the range of about 0.25 inches to about 3 inches and a thickness in the range of from about 0.003 inches to about 0.020 inches.

8. A mounting clip as in claim 2 which is formed from stainless steel spring stock having a length in the range of about 1 inch to about 3 inches and a width in the range of about 0.5 inches to about 1 inch and a thickness in the range of from about 0.009 inches to about 0.015 inches.

* * * * *